US006666653B1

(12) United States Patent
Carrier

(10) Patent No.: US 6,666,653 B1
(45) Date of Patent: Dec. 23, 2003

(54) INERTIA WELDING OF BLADES TO ROTORS

(75) Inventor: Charles William Carrier, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/159,427

(22) Filed: May 30, 2002

(51) Int. Cl.[7] ..... F01D 5/30
(52) U.S. Cl. ..... 416/213 R; 416/234; 29/889.21
(58) Field of Search ..... 416/213 R, 234; 29/889.21, 889.23

(56) References Cited

U.S. PATENT DOCUMENTS

| | | | | |
|---|---|---|---|---|
| 3,571,906 A | * | 3/1971 | Barth et al. | 228/113 |
| 4,705,463 A | | 11/1987 | Joco | |
| 4,743,165 A | | 5/1988 | Ulrich | |
| 5,188,279 A | | 2/1993 | Joyce et al. | |
| 5,197,857 A | | 3/1993 | Glynn et al. | |
| 5,205,465 A | | 4/1993 | Bogard et al. | |
| 5,366,344 A | * | 11/1994 | Gillbanks et al. | 416/213 R |
| 5,468,334 A | | 11/1995 | Searle | |
| 5,486,262 A | | 1/1996 | Searle | |
| 5,518,562 A | | 5/1996 | Searle et al. | |
| 6,095,402 A | | 8/2000 | Brownell et al. | |
| 6,138,896 A | | 10/2000 | Ablett et al. | |
| 6,160,237 A | | 12/2000 | Schneefeld et al. | |
| 6,199,744 B1 | | 3/2001 | Schneefeld et al. | |
| 6,296,445 B1 | | 10/2001 | Chasseguet et al. | |
| 6,324,831 B1 | | 12/2001 | Izadi et al. | |
| 6,326,585 B1 | | 12/2001 | Aleshin et al. | |

* cited by examiner

*Primary Examiner*—Ninh H. Nguyen
(74) *Attorney, Agent, or Firm*—V. G. Ramaswamy; Steven J. Rosen

(57) ABSTRACT

A method for manufacturing an integrally bladed rotor includes fixturing a plurality of blade blanks having radially inwardly facing blade conical surfaces into a segmented blade ring assembly circumscribed around an axis. A rotor ring having a radially outwardly facing ring conical surface circumscribed around the axis is rotated to a contact speed. The rotor ring is fictionally engaged under an axially applied weld load with the blade ring assembly to effect a conical inertia weld along the mating blade conical surfaces and ring conical surface. The integrally bladed rotor includes a plurality of airfoils circumferentially distributed about and integral with a rim. The airfoils extend radially outwardly from respective airfoil bases on a radially outer flowpath surface of the rim to airfoil tips. A conical inertia weld is located between the airfoil tips and a radially inwardly facing rim surface of the rim.

23 Claims, 7 Drawing Sheets

INERTIA WELDING OF BLADES TO ROTORS

BACKGROUND OF THE INVENTION

FIELD OF THE INVENTION

The present invention relates generally to construction of gas turbine engine integrally bladed rotors and, more specifically, to inertia welding of blades to gas turbine engine rotors.

Fan, compressor and other gas turbine engine rotors may have a BLISK or a BLUM. BLISKS have blades that are integral with a disk and BLUMS have blades that are integral with a drum. Conventionally, BLISKS and BLUMS are made by machining an airfoil shape (using conventional machining or ECM/EDM processes) from a forged disk. Linear and angularly reciprocating friction welding methods have been under development for manufacturing BLISKS and BLUMS for gas turbine engine rotors. Angularly reciprocating friction welding includes the disc or drum rotor being angularly reciprocated while the airfoils or blades are pressed radially against the disk or rotor circumference. Linear reciprocating friction welding includes linear reciprocating airfoils or the blades as they are pressed radially against the disk or rotor circumference.

In friction welding, the disk is clamped, a blade is clamped in a reciprocating head of a machine, and the blade is rubbed against a surface of the disk in a reciprocating motion to generate frictional heat at an interface between the disk and the blade. When a predetermined loss of length is achieved, the blade is brought suddenly to a halt at a precisely defined location on the disk and is pressed against the disk for a short time to create the weld. When the blade and disk assembly has cooled flash at the interface is removed and any required machining operations are carried out.

One drawback to using BLISKS and BLUMS is the high manufacturing cost. The manufacturing processes described above are expensive and complex to perform on airfoil shapes, particularly, the complex shapes used today and being developed for future use. Additionally, the disk material and the airfoil material must meet different design requirements. Machining the blisk from one piece often requires compromises in the part design or material selection.

BRIEF DESCRIPTION OF THE INVENTION

A method for manufacturing an integrally bladed rotor includes fixturing a plurality of blade blanks having radially inwardly facing blade conical surfaces in a segmented blade ring assembly circumscribed around an axis. A rotor ring is rotated to a contact speed. The rotor ring has a radially outwardly facing ring conical surface circumscribed around the axis and mates to the blade conical surfaces. The rotor ring and the segmented blade ring assembly are frictionally engaged under an axially applied weld load to effect a conical inertia weld therebetween along the mating blade conical surfaces and ring conical surface. In one embodiment, each of the blade blanks includes an airfoil portion extending radially outwardly from an annular base portion and the base portion includes the mating blade conical surfaces. The base portion includes a radially outer conical surface parallel to the blade conical surface and the conical inertia weld passes through the airfoil portion. Completed airfoils and radially outer flowpath surface are formed by machining excess stock from the base portion and the rotor ring after the welding. Materials of the blade blanks and the rotor ring may be two different alloys.

In another embodiment, each of the blade blanks includes a rim portion of the integrally bladed rotor and the conical inertia weld is between the rim portions and a conical rotor ring. Holes may be machined in an annular region of the rim. The holes may be circumferentially evenly distributed within the annular region and centered along radii passing through interfaces the blade blanks.

The invention includes the integrally bladed rotor and the airfoils circumferentially distributed about and integral with the rim. The airfoils extend radially outwardly from respective airfoil bases on a radially outer flowpath surface of the rim to airfoil tips. A conical inertia weld is located between the airfoil tips and a radially inwardly facing rim surface of the rim.

DETAILED DESCRIPTION OF THE INVENTION

Figure 1:
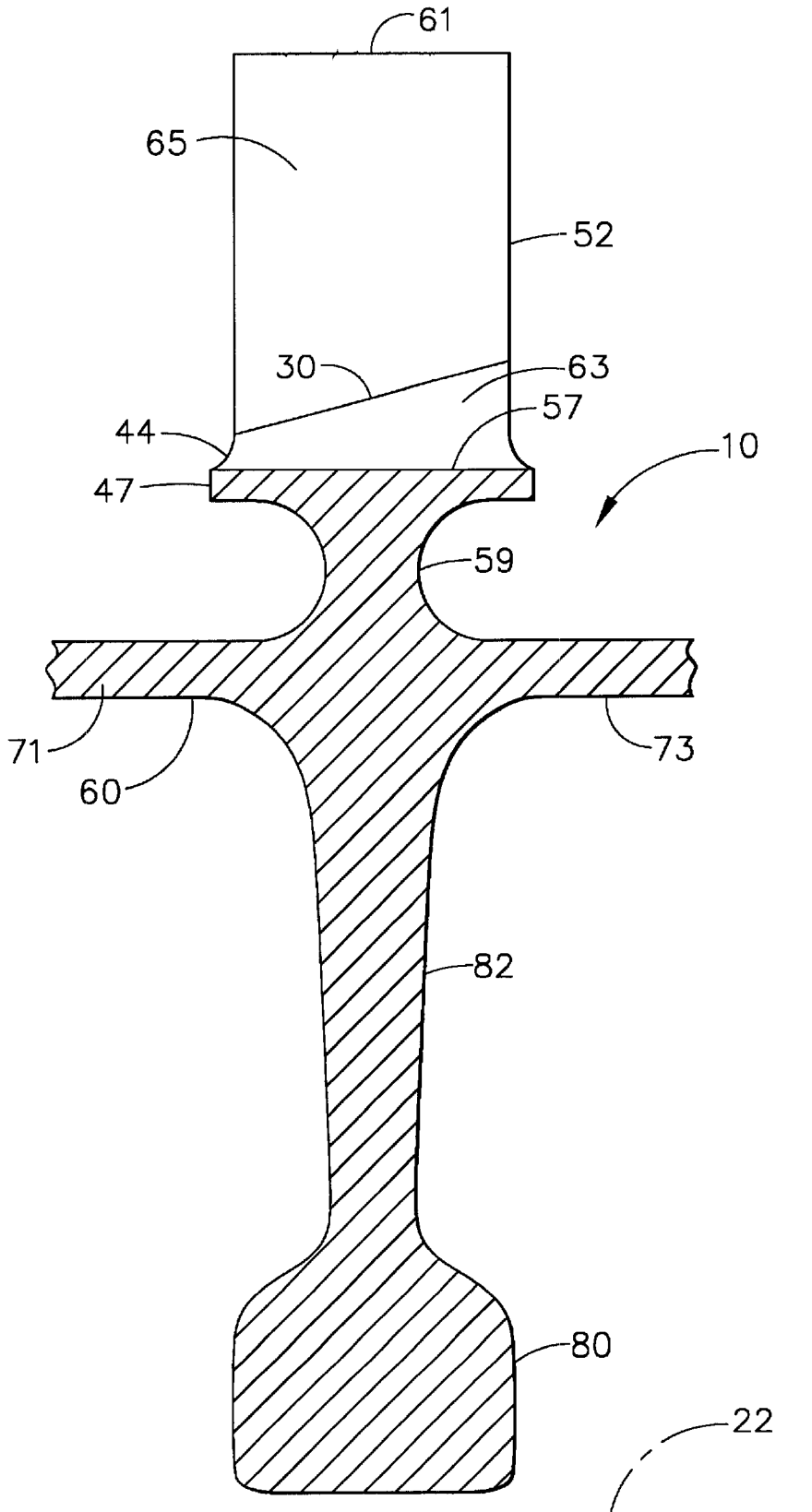
FIG. 1 is a schematic cross-sectional view illustration of a portion of an exemplary gas turbine engine compressor integrally bladed rotor including a rim and a conical weld.

Illustrated in FIG. 1 is a portion of gas turbine engine integrally bladed rotor 10. The portion may be from a fan or compressor and may be part of a BLISK or a BLUM. BLISKS have blades that are integral with a disk and BLUMS have blades that are integral with a drum. The integrally bladed rotor 10 includes a hub 80, a web 82 extending radially outwardly from the hub to an annular rim 59 and circumscribed around an axis 22. A plurality of airfoils 52 extend radially outwardly from, are circumferentially disposed about, and integral with the rim 59. The airfoils 52 extend radially outwardly from respective airfoil bases 57 on a radially outer flowpath surface 44 of platforms 47 formed in the rim 59 to airfoil tips 61. Forward and aft axial extensions 71 and 73 may be arms of a disk or annular rotor sections of a drum. The airfoils 52 include radially inner and outer sections 63, 65 bonded together along a conical inertia weld 30 radially located between the bases 57 and the tips 61. The inertia weld 30 is generally located between the tips 61 and a radially inwardly facing rim surface 60 of said rim 59. The airfoils 52 and the rim 59 may be made from two different alloys.

Figure 5:
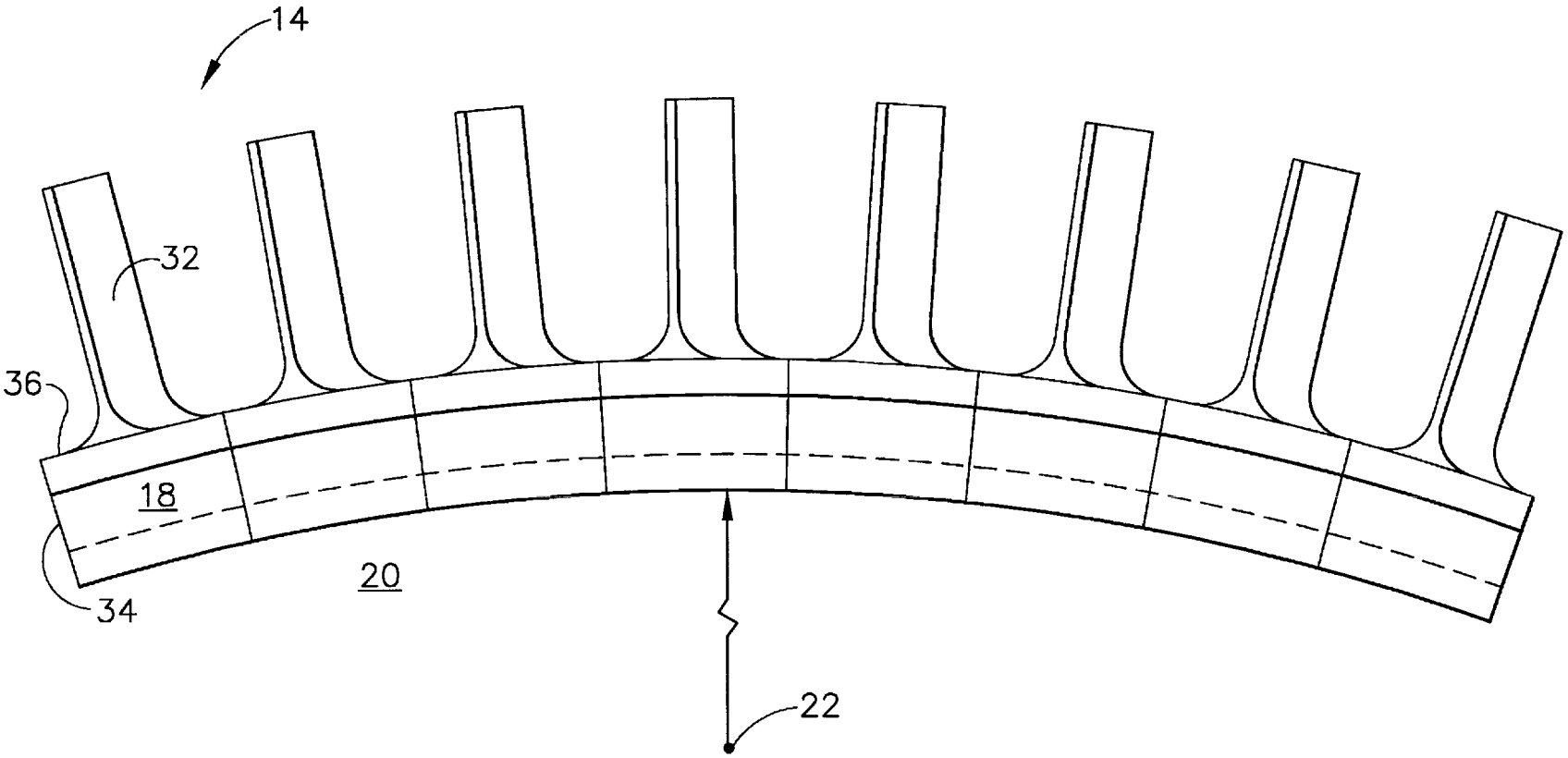
FIG. 5 is an aft looking forward elevational view illustration of a sector of a segmented blade ring assembly of the blade blanks arranged to be inertia welded to form the integrally bladed rotor illustrated in FIG. 1.
Figure 6:
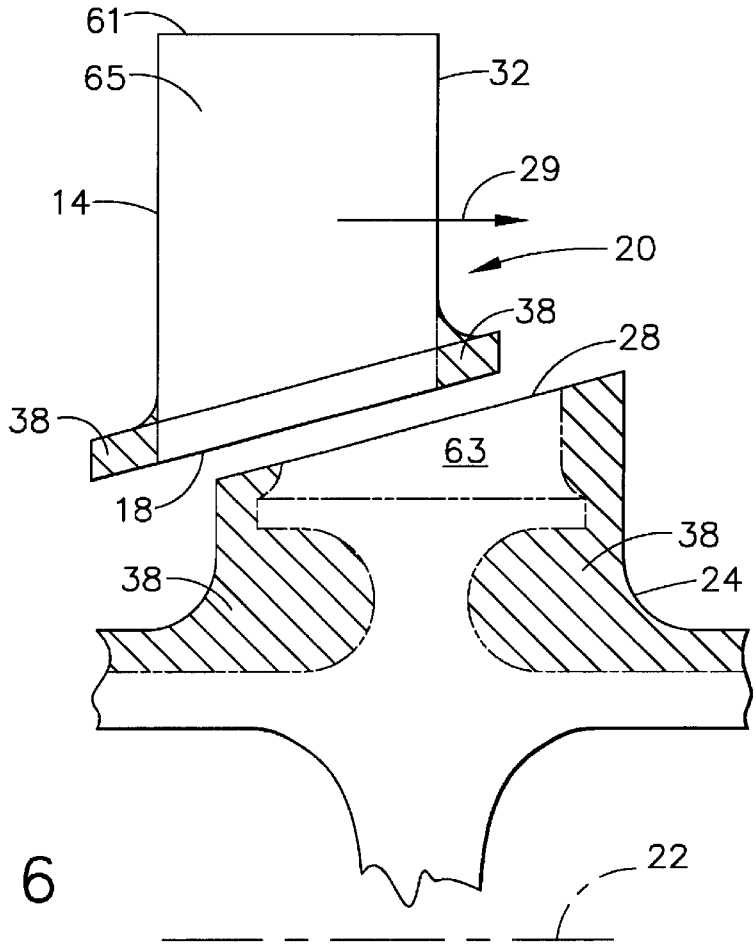
FIG. 6 is a cross-sectional view illustration of one of the blade blanks of the segmented blade ring assembly being inertia welded to form the integrally bladed rotor illustrated in FIG. 1.

The integrally bladed rotor 10 is manufactured in part by fixturing a plurality of blade blanks 14 into a segmented blade ring assembly 20, illustrated in FIG. 5, circumscribed around the axis 22 as illustrated in FIG. 6. Rotation is effected between a rotor ring 24 and the blade ring assembly 20 such as by rotating the rotor ring 24 to contact speed for inertia welding as illustrated in FIG. 6. The rotor ring and the segmented blade ring assembly 20 are frictionally engaged under an axially applied weld load 29 to effect the conical inertia weld 30 therebetween and along mating blade conical surfaces 18 of the blade blanks 14 and a ring conical surface 28 of the rotor ring 24.

Figure 2:
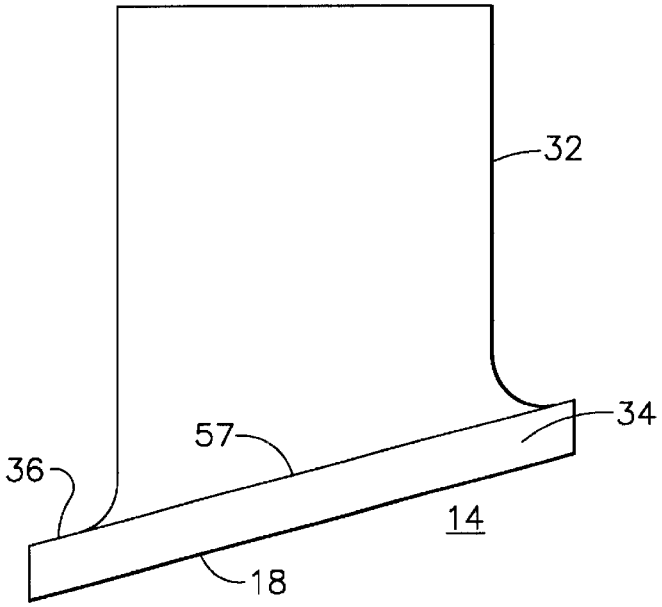
FIG. 2 is a side elevational view illustration of a blade blank to be inertia welded to a rotor ring to form the integrally bladed rotor illustrated in FIG. 1.
Figure 4:
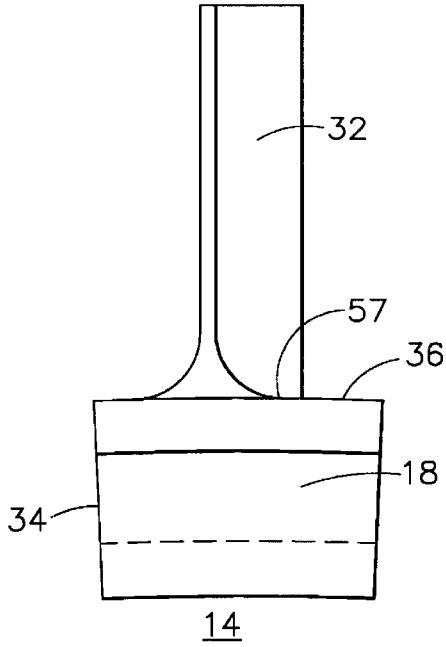
FIG. 4 is an aft looking forward side elevational view illustration of the blade blank illustrated in FIG. 1.
Figure 3:
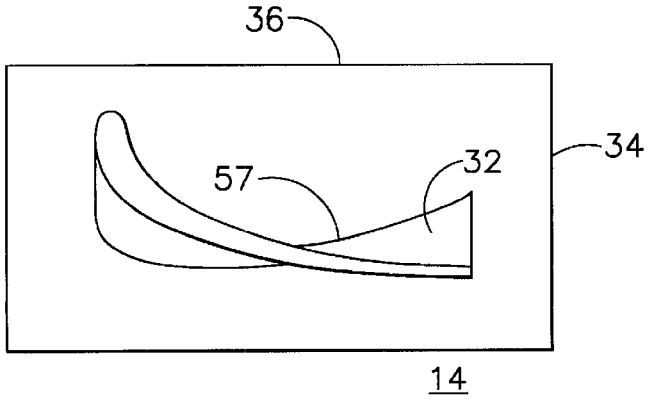
FIG. 3 is a radially inwardly looking elevational view illustration of the blade blank in illustrated FIG. 1.

Referring to FIGS. 2, 3, and 4, each one of the blade blanks 14 has an airfoil portion 32 extending radially outwardly from an annular base portion 34. The base portion 34 includes the radially inwardly facing blade conical surfaces 18 and a radially outer conical surface 36 parallel to the blade conical surface 18. The conical inertia weld 30, illustrated in FIG. 1, is effected between the annular base portions 34 and the rotor ring 24. The completed airfoils 52, the platforms 47 formed in the rim 59, and the radially outer flowpath surface 44 are formed by machining excess stock 38 from the base portion 34 and the rotor ring 24 after the welding as illustrated in FIG. 1. Final shapes of the airfoils 52 are machined after welding from the radially inner and outer sections 63, 65. Materials of the blade blanks 14 and the rotor ring 24 may be two different alloys.

Figure 7:
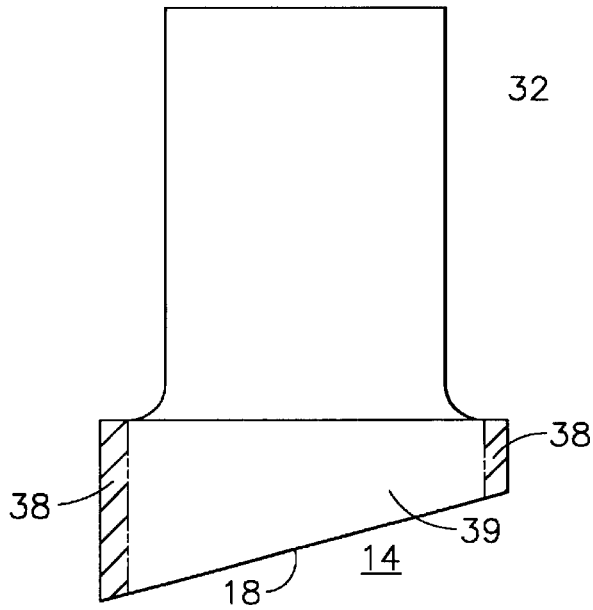
FIG. 7 is a side elevational view illustration of an alternative blade blank to be inertia welded to an alternative rotor ring to form an alternative integrally bladed rotor illustrated in FIG. 10.
Figure 8:
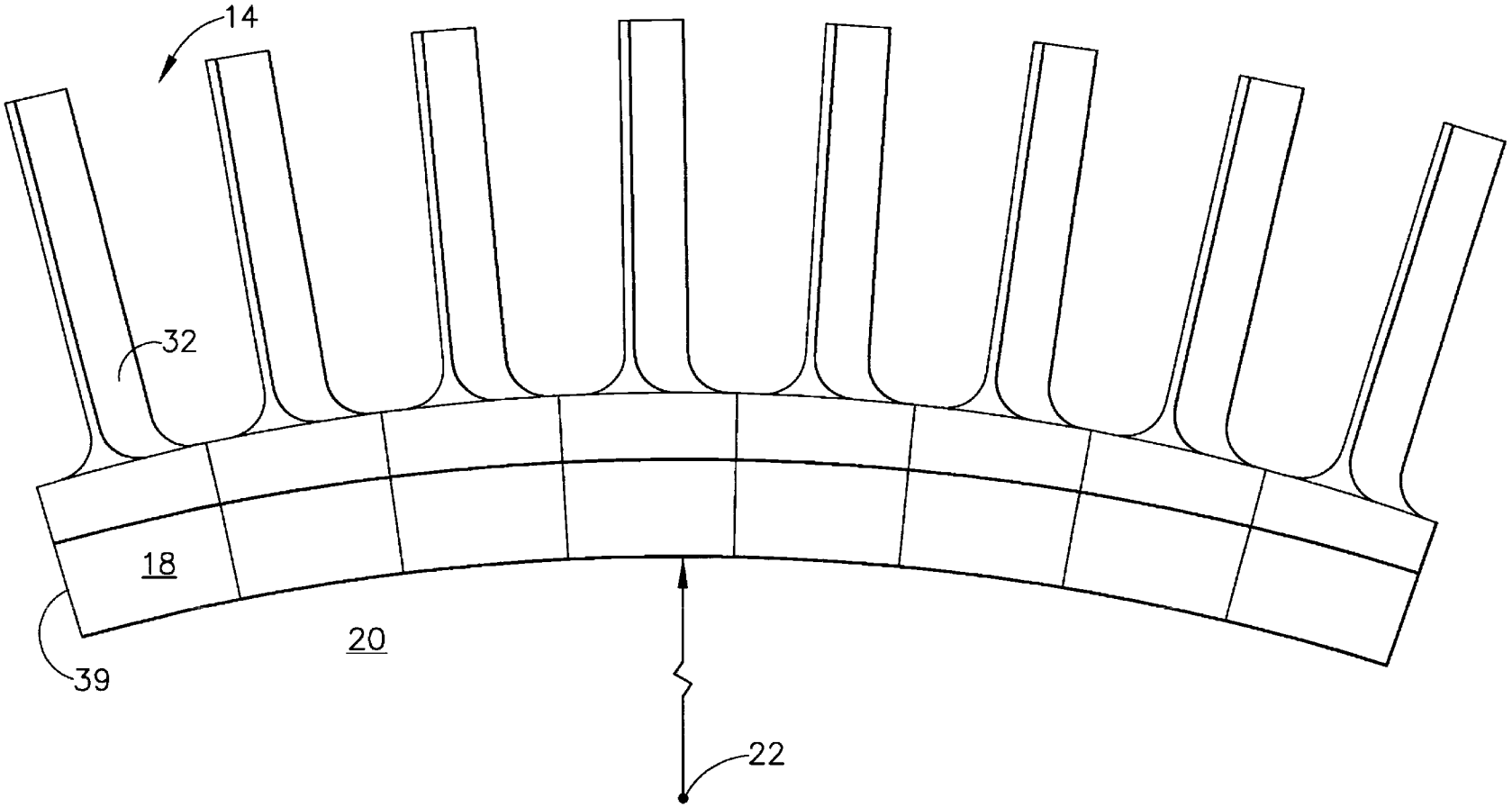
FIG. 8 is an aft looking forward elevational view illustration of a sector of an alternative segmented blade ring assembly to be welded to the alternative blade blanks illustrated in FIG. 7.
Figure 10:
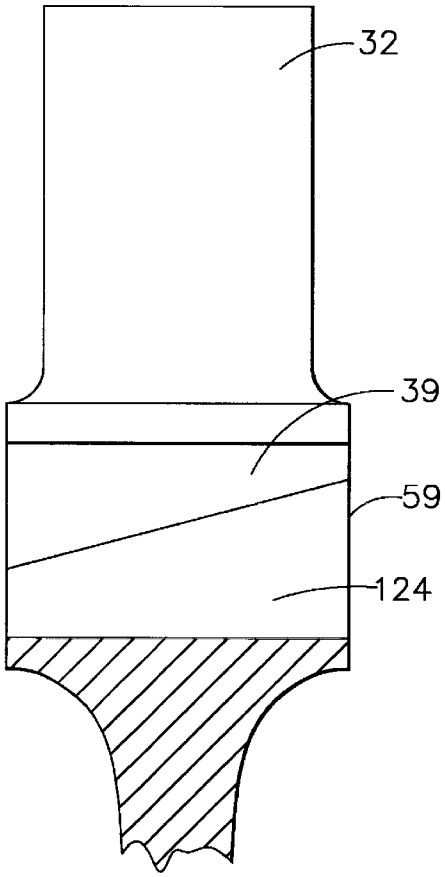
FIG. 10 is a cross-sectional view illustration of the alternative integrally bladed rotor made by inertia welding the alternative blade blanks to the segmented blade ring assembly.
Figure 9:
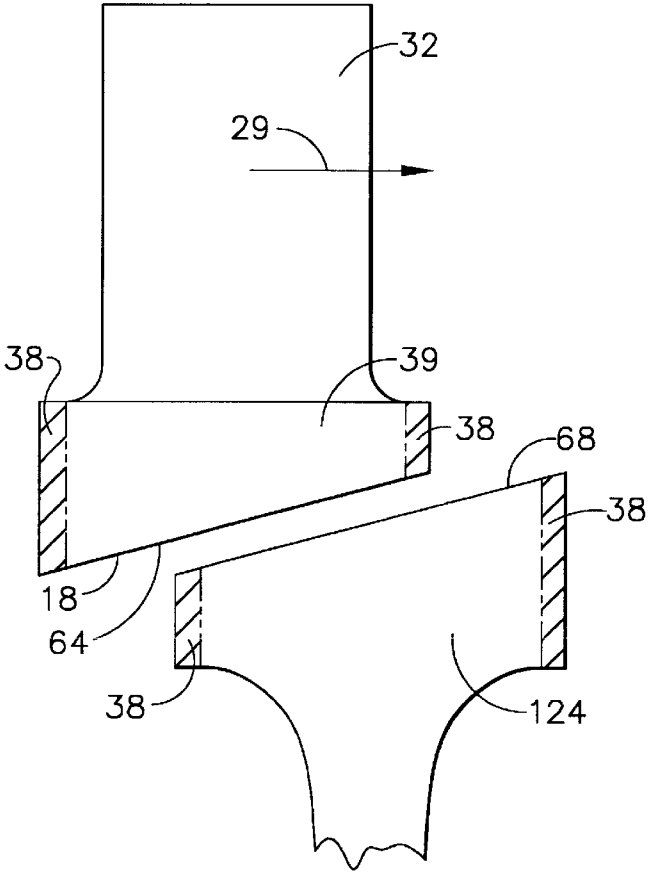
FIG. 9 is a cross-sectional view illustration of one of alternative the blade blanks being inertia welded to the segmented blade ring assembly to form the alternative integrally bladed rotor illustrated in FIG. 10.
Figure 12:
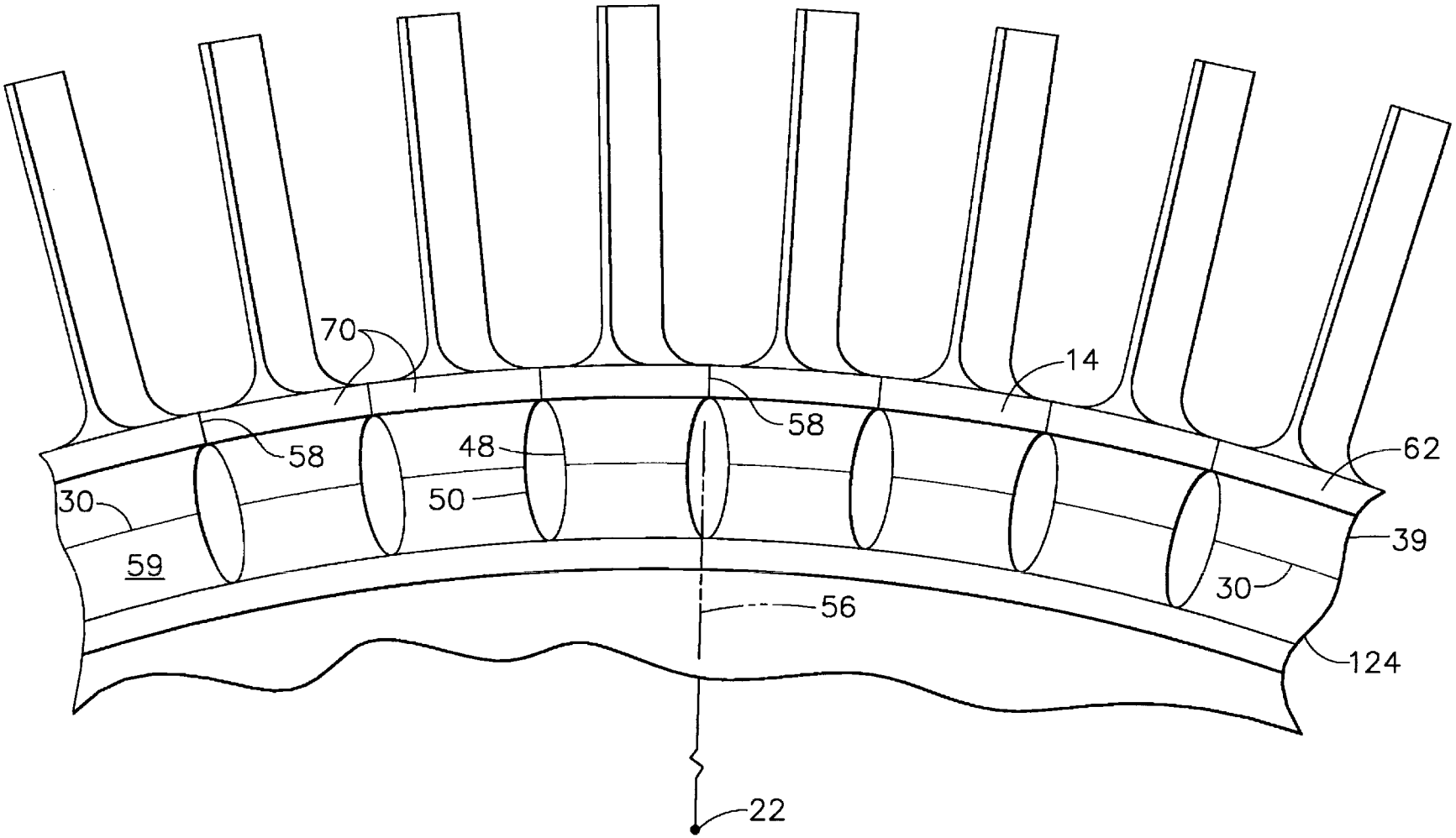
FIG. 12 is a schematic cross-sectional view illustration of the alternative gas turbine engine compressor integrally bladed rotor in FIG. 11 with holes through the rim of the rotor.

Illustrated in FIGS. 7, 8 , and 9 is an alternative embodiment of the blade blanks 14, each of which includes a rim portion 39 used to form the rim 59 of the integrally bladed rotor 10. The conical inertia weld 30 is formed between and bonds the rim portions 39 and a conical rotor ring 124. The blade conical surfaces 18 are located on the rim portions 39 of the blade blanks 14. The airfoils 52 and the rim 59 may be made from two different alloys. The integrally bladed rotor 10 is manufactured in part by fixturing the plurality of the blade blanks 14, illustrated in FIG. 8, into the segmented blade ring assembly 20 circumscribed around the axis 22 as illustrated in FIG. 8. Rotation is effected between the conical rotor ring 124 and the blade ring assembly 20 such as by rotating the conical rotor ring 124 to contact speed for inertia welding as illustrated in FIG. 9. The conical rotor ring 124 and the segmented blade ring assembly 20 are frictionally engaged under an axially applied weld load 29 to effect a conical inertia weld 30 therebetween and along mating blade conical surfaces 18 of the blade blanks 14 and a ring conical surface 28 of the conical rotor ring 124 as illustrated in FIG. 10.

Figure 11:
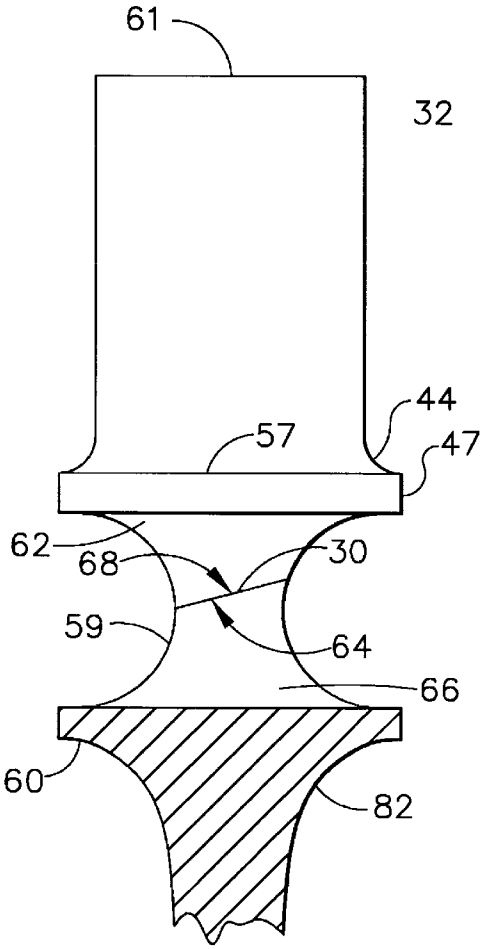
FIG. 11 is a cross-sectional view illustration of the alternative integrally bladed rotor in FIG. 10 after post welding machining.

Illustrated in FIG. 11 are the completed airfoils 52, the platforms 47 formed in the rim 59, and the radially outer flowpath surface 44 are formed by machining the excess stock 38 from the rim portion 39 base and the conical rotor ring 124 after the welding. The rim 59 is formed from the rim portions 39 of the blade blanks 14 and the conical rotor ring 124. The airfoils 52 extend radially outwardly of and are formed integral with a radially outer annular portion 62 of the rim 59. The radially outer annular portion 62 has a radially inwardly facing conical boundary 64 and is formed from the rim portions 39 of the blade blanks 14. A radially inner portion 66 of the rim 59 is machined from the conical rotor ring 124 and has a radially outwardly facing conical boundary 68. The conical inertia weld 30 is disposed between the radially inner and outer annular portions 66,62 of the rim 59 along the radially inwardly and outwardly facing conical boundaries 64, 68.

Holes 48 may be machined in an annular region 50 of the rim 59 after the welding. The holes 48 may be circumferentially evenly distributed within the annular region 50 and centered along radii 56 passing through interfaces 58 between segments 70 of the outer annular portion 62 of the rim 59 formed by the blade blanks 14. The annular region 50 is located in the welded together rim portions 39 and the conical rotor ring 124.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed is:

1. A method for manufacturing an integrally bladed rotor comprising:

fixturing a plurality of blade blanks having radially inwardly facing blade conical surfaces into a segmented blade ring assembly circumscribed around an axis, rotating a rotor ring to a contact speed, said rotor ring having a radially outwardly facing ring conical surface circumscribed around said axis and that mates to said blade conical surfaces, and frictionally engaging under an axially applied weld load said segmented blade ring assembly and said rotor ring to effect a conical inertia weld therebetween along said mating blade conical surfaces and ring conical surface.

2. A method as claimed in claim 1 wherein each of said blade blanks includes an airfoil portion extending radially outwardly from an annular base portion and said base portion includes said mating blade conical surfaces.

3. A method as claimed in claim 2 wherein said base portion includes a radially outer conical surface parallel to said blade conical surface and said conical inertia weld passes through said airfoil portion.

4. A method as claimed in claim 3 further comprising forming completed airfoils and radially outer flowpath surface by machining stock from said base portion and said rotor ring after said welding.

5. A method as claimed in claim 2 wherein material of said blade blanks and said rotor ring are two different alloys.

6. A method as claimed in claim 5 wherein said base portion includes a radially outer conical surface parallel to said blade conical surface and said conical inertia weld passes through said airfoil portion.

7. A method as claimed in claim 6 further comprising forming completed airfoils and radially outer flowpath surface by machining stock from said base portion and said rotor ring after said welding.

8. A method as claimed in claim 2 wherein said rotor ring is a conical rotor ring, each of said blade blanks includes a rim portion of said integrally bladed rotor and said conical inertia weld is between said rim portions and said conical rotor ring.

9. A method as claimed in claim 8 further comprising forming completed airfoils and radially outer flowpath surface by machining stock from said base portion and said conical rotor ring after said welding.

10. A method as claimed in claim 9 further comprising machining holes in an annular region of said rim portions and said conical rotor ring after said welding.

11. A method as claimed in claim 10 wherein said holes are circumferentially evenly distributed within said annular region and centered along radii passing through interfaces between said blade blanks.

12. A method as claimed in claim 8 wherein material of said blade blanks and said conical rotor ring are two different alloys.

13. A method as claimed in claim 12 further comprising forming completed airfoils and radially outer flowpath surface by machining stock from said base portion and said conical rotor ring after said welding.

14. A method as claimed in claim 13 further comprising machining holes in an annular region of said rotor ring and said blade blanks after said welding.

15. A method as claimed in claim 14 wherein said holes are circumferentially evenly distributed within said annular region and centered along radii passing through interfaces between said blade blanks.

16. An integrally bladed rotor comprising:

a plurality of airfoils circumferentially disposed about and integral with a rim, said airfoils extending radially outwardly from respective airfoil bases on a radially outer flowpath surface of said rim to airfoil tips, and a conical inertia weld located between said airfoil tips and a radially inwardly facing rim surface of said rim.

17. An integrally bladed rotor as claimed in claim 16 wherein said airfoils include radially inner and outer sections bonded together along said conical inertia weld radially located between said bases and said tips.

18. An integrally bladed rotor as claimed in claim 17 further comprising material of said airfoils and said rim being two different alloys.

19. An integrally bladed rotor as claimed in claim 16 further comprising:

said airfoils integral with a radially outer annular portion of said rim, said radially outer annular portion having a radially inwardly facing conical boundary, a radially inner annular portion of said rim has a radially outwardly facing conical boundary, and said conical inertia weld passes through said rim between said radially inner and outer annular portion of said rim along said radially inwardly facing conical boundaries.

20. An integrally bladed rotor as claimed in claim 19 wherein said airfoils and said outer annular portion are made from a first alloy and said inner annular portion of said rim is made from a second alloy different from said first alloy.

21. An integrally bladed rotor as claimed in claim 19 wherein said outer annular portion of said rim is segmented and includes interfaces between segments of said outer annular portion.

22. An integrally bladed rotor as claimed in claim 21 further comprising holes in an annular region of said rim.

23. An integrally bladed rotor as claimed in claim 22 wherein said holes are circumferentially evenly distributed within said annular region and centered along radii passing through interfaces between said segments.

* * * * *